US007275265B2

(12) United States Patent
Grant

(10) Patent No.: US 7,275,265 B2
(45) Date of Patent: Oct. 2, 2007

(54) CLOSE-FITTING GARMENT AND METHOD FOR AVOIDING SHINGLES SCRATCHING

(76) Inventor: John Grant, 296-54A Street, South Delta, British Columbia (CA) V4M 3J3

( * ) Notice: Subject to any disclaimer, the term of this patent is extended or adjusted under 35 U.S.C. 154(b) by 0 days.

(21) Appl. No.: 10/986,721

(22) Filed: Nov. 12, 2004

(65) Prior Publication Data

US 2005/0097653 A1 May 12, 2005

(30) Foreign Application Priority Data

Nov. 10, 2003 (CA) ..... 2453006

(51) Int. Cl.
*A41B 9/00* (2006.01)

(52) U.S. Cl. ..... 2/78.1; 2/73; 128/873

(58) Field of Classification Search ..... 2/105–107, 2/109, 80, 81, 84, 83, 113–115, 69, 73, 78.1–78.4, 2/79; 128/873, 874
See application file for complete search history.

(56) References Cited

U.S. PATENT DOCUMENTS 948,199 A * 2/1910 Anderson ..... 2/77
1,656,304 A * 1/1928 Tetreau ..... 602/67
2,067,870 A * 1/1937 Blackwell ..... 2/78.2
4,057,854 A * 11/1977 Phelps, Sr. ..... 2/128
4,455,685 A 6/1984 Steffler et al.
4,912,780 A * 4/1990 Falack ..... 2/102
5,479,661 A * 1/1996 Fingleson et al. ..... 2/69
5,653,244 A 8/1997 Shaw
5,906,206 A 5/1999 Shaw et al.
5,918,602 A 7/1999 Shaw et al.
5,933,864 A 8/1999 Boykins
6,440,159 B1 8/2002 Edwards et al.

* cited by examiner

*Primary Examiner*—Gloria M. Hale
(74) *Attorney, Agent, or Firm*—Frederick Kaufman

(57) ABSTRACT

The garment made of stretchable material is adapted for an upper part of a body. The garment has front and back sections and a hem; a front of the hem is provided with a pair of slits, while a back—with a pair of apertures. A lace for fastening the garment to the upper part of the body is used. This lace has a pair of ends and is adapted to encircle a waist and to interact with the pair of slits and apertures. The first and second ends, after exiting from the pair of slits, are manipulated so as to extend downwardly and brought under the crotch area and then up toward the back of the wearer. There, first and second ends are inserted into the pair of apertures, behind lace, then brought forward, stretched and tied together.

3 Claims, 3 Drawing Sheets

CLOSE-FITTING GARMENT AND METHOD FOR AVOIDING SHINGLES SCRATCHING

I. BACKGROUND OF THE INVENTION

1. Field of the Invention

The present invention refers in general to garments and methods for alleviating pains and in particular to a close-fitting garment and a method for avoiding shingles scratching.

2. Description of the Prior Knowledge

Shingles is a disease caused by the same varicella-zoster virus that causes chickenpox. Shingles most commonly occurs in older people.

Pain may come first, but when the migrating virus finally reaches the skin—usually the second to the fifth day after the first symptoms—the rash starts. The virus infects the skin cells and creates a painful, red rash that resembles chickenpox. To resist scratching the itchy rash is difficult and the damaged skin may develop a bacterial infection requiring antibiotic treatment. After such an infection, the skin may be left with significant scarring, some of it serious enough to require plastic surgery.

Traditional treatments for those suffering from shingles can be described as follows:

Although viral disease can't be cured, doctors prescribe, to relieve pain, oral antiviral medications that help control the infection by hindering reproduction of the virus in the nerve cells.

Also to relieve pain, the doctors recommend over-the-counter analgesics belonging to a class of medications known as nonsteroidal anti-inflammatory drugs.

Doctors use other methods to alleviate pain. Thus, a patch containing a transdermal form of iodine is applied. That patch is prescribed for patients who had intolerable side effects with oral medications. The medication contained in this soft, pliable patch penetrates the skin, reacting with the damaged nerves just under the skin, without being absorbed significantly in the bloodstream.

Yet another method to alleviate pain is transcutaneous electrical nerve stimulation, or TENS. A device that generates low-level pulses of electrical current is applied to the skin surface, causing tingling sensations and offering some people pain relief. One theory as to how TENS works is that electrical current simulates the production of endorphins, the body natural painkillers.

TENS is not for everyone. Low doses of the electrical current are not effective. When the current is increased, it gives a painful response.

As a last resort, invasive procedures called nerve blocks may be used to provide temporary relief. These procedures usually use the injection of a local anesthetic into the area of affected nerves. The results are controversial in the terms of the efficiency of nerve blocks.

Injection directly into the spine is another option for relief.

II. SUMMARY OF THE INVENTION

The present invention relies on the unexpected observation of the applicant, who suffers from shingles that a close-fitting garment, made of soft and stretchable material according to his design, can prevent the sliding of this garment over the skin. Thus, the scratching the itchy rash caused by shingles can be partially or entirely avoided.

Beside the use of the above material and an appropriate size, the close-fitting garment must be also provided with an adjustable fastening feature to create longitudinally and circumferentially a highly-tensioned fit over the torso and the waist of a wearer.

The applicant believes that there is no existing knowledge relating to the use of close-fitting garments for a condition such as shingles and that there is not a close-fitting garment in the prior art which structurally and functionally resembles to his garment or can be used for improving the state of a person suffering from shingles.

A first objective of this invention is to design a close-fitting garment that can be removably positioned and attached against and about the torso and waist of a wearer.

A second objective of this invention is to design a close-fitting garment that can be adjustably fastened to the body to avoid the sliding of the material of the garment over the skin.

In order to accomplish these objectives, the applicant developed a close-fitting garment, adapted to avoid scratching an itchy rash caused by shingles.

The close-fitting garment comprises a sleeveless, tank top type garment, made of a soft and stretchable material and adapted for covering an upper part of a body. The sleeveless, tank top type garment has front and back sections ending with a hem; a portion of the hem corresponding to the front portion is provided with a pair of slits, while another portion of the hem corresponding to the back portion is provided with a pair of apertures. The close-fitting garment includes as well a feature for adjustably fastening the sleeveless, tank top type garment to the upper part of the body. The feature for adjustably fastening includes a lace having a pair of ends and is adapted to encircle a waist of a person wearing said close-fitted garment and to be used in connection with said pair of slits and said pair of apertures to create a longitudinal and a circumferential close-fitting of said sleeveless, tank top type of garment.

A method of avoiding scratching an itchy rash caused by shingles comprises the following steps:

- providing a close-fitting garment including
  - a sleeveless, tank top type garment, made of a soft and stretchable material adapted for covering a part of a body, said sleeveless, tank top type garment having front and back sections ending with a hem, a portion of said hem that corresponds to said front portion being provided with a pair of slits, while another portion of said hem that corresponds to said back portion being provided with a pair of apertures;
  - means for adjustably fastening said sleeveless, tank top type garment to said upper part of the body, said means for adjustably fastening including
    - a lace having a pair of ends and adapted to encircle a waist of a person wearing said close-fitted garment and to be used in connection with said pair of slits and said pair of apertures to create a longitudinal and a circumferential close-fitting of said sleeveless, tank top type of garment;
- positioning said sleeveless, tank top type garment, against and about said part of said body;
- manipulating one of said ends of said lace by inserting it into one of said pairs of slits;
- threading said one of said ends through said hem;
- pulling out said one of said ends through another one of said pair of slits until said pair of ends have substantially the same length;
- bringing said pair of ends under a crotch area of a wearer of said close-fitting garment and then toward a back of said wearer;

inserting said pair of ends into said pair of apertures, behind said lace;

bringing forward and stretching said pair of ends; and finally tying together said pair of ends.

III. BRIEF DESCRIPTION OF THE DRAWINGS

Although the characteristic features of the invention will be particularly pointed out in the claims, the invention itself and the manner in which it may be made and used may be better understood by referring to the following description and accompanying drawings. Like reference numerals refer to like parts throughout the several views of the drawings in which:

IV. DESCRIPTION OF THE PREFERRED EMBODIMENT

Figure 1:
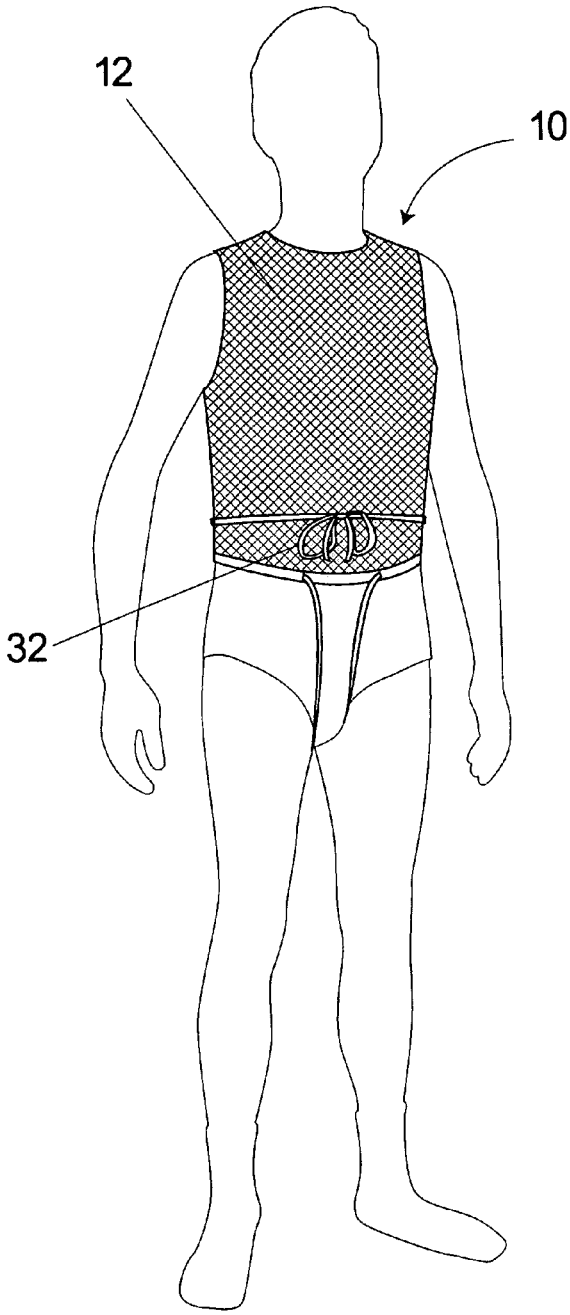
FIG. 1 illustrates a front view of the close-fitting garment positioned on and attached to a patient body.
Figure 2:
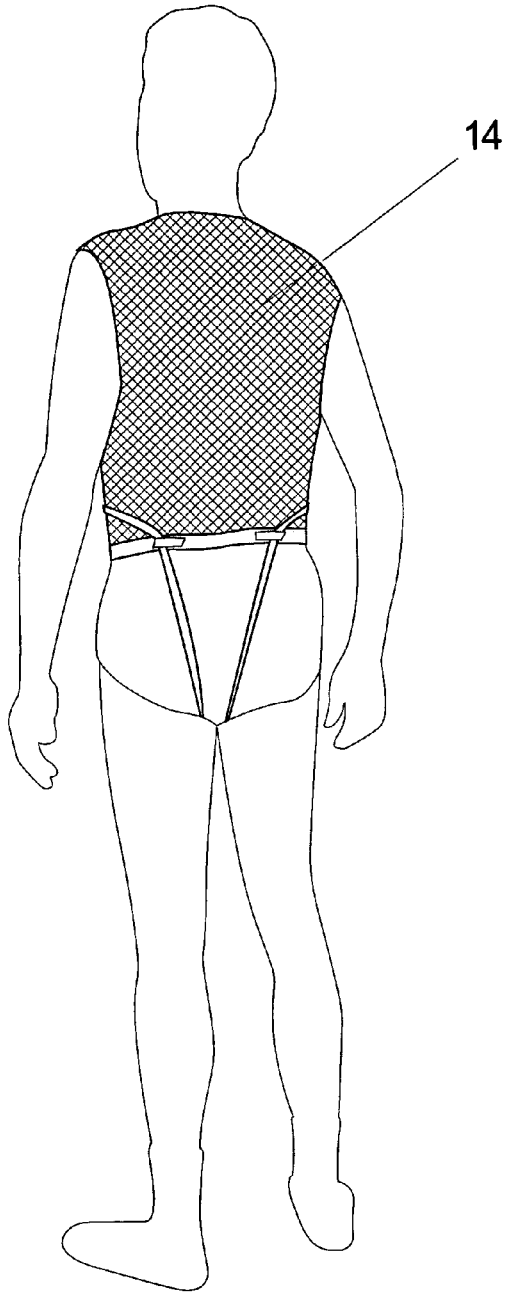
FIG. 2 illustrates a back view of the close-fitting garment positioned on and attached to a patient body.

Referring now to FIGS. 1 and 2, the proposed close-fitting garment 10 is shown in front and back views.

It should be agreed, that terms such as "front", "back", "lower", "upwardly" and "downwardly" are selected in the present description with reference to the position in which close-fitting garment 10 would be used.

Close-fitting garment 10 has a sleeveless, tank top shape, preferably seamless, made of tubular, knit fabric, with a front section 12 and a back section 14, and is provided with openings 16 and 18 for the neck and hands, respectively. Front and back sections 12 and 14, respectively, are intersected by a vertical plan of symmetry V-V.

Close-fitting garment 10 is so positioned as to cover the torso and a waist region that surrounds the abdomen.

Figure 3:
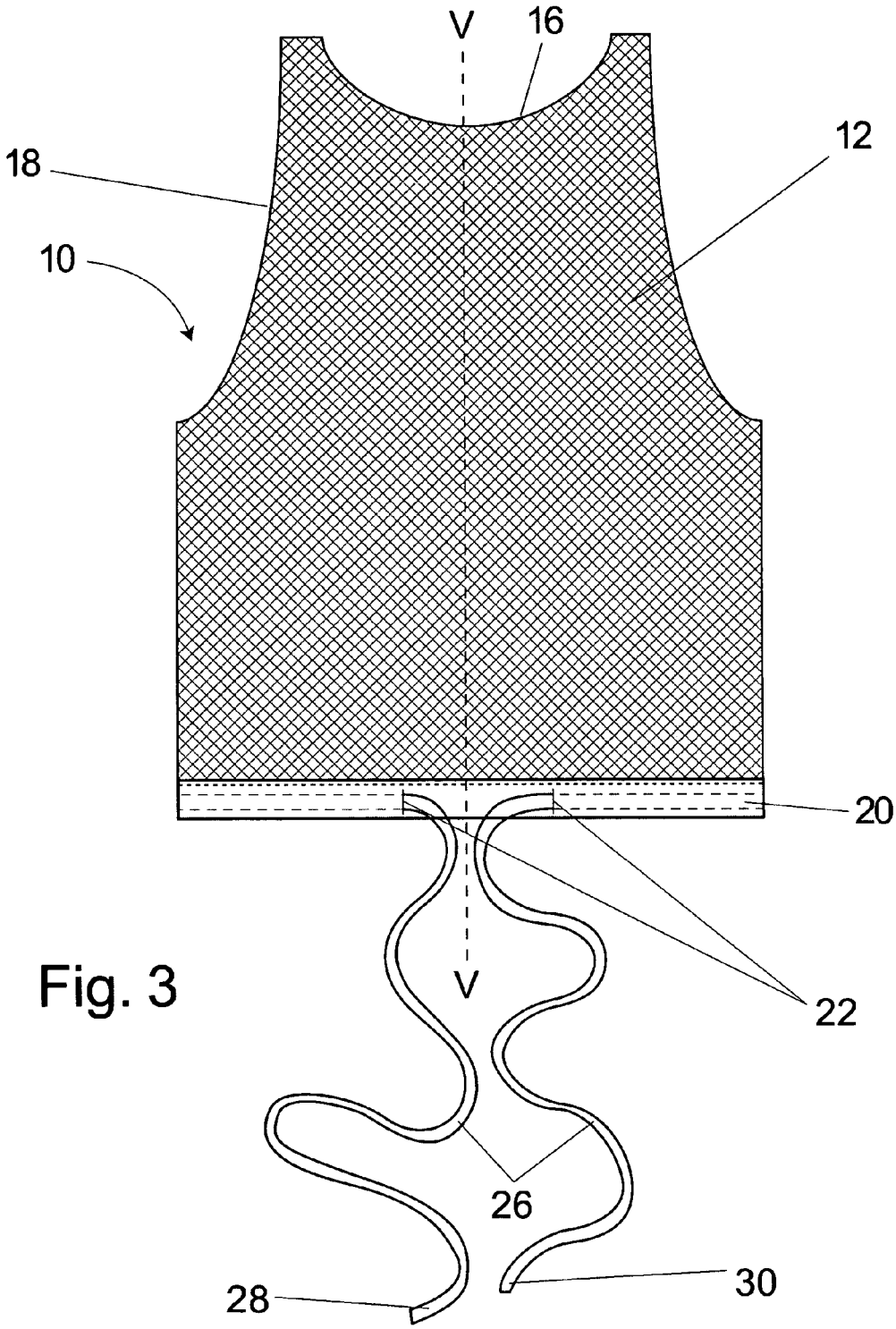
FIG. 3 illustrates an enlarged front view of the garment with a lace threaded along the hem.
Figure 4:
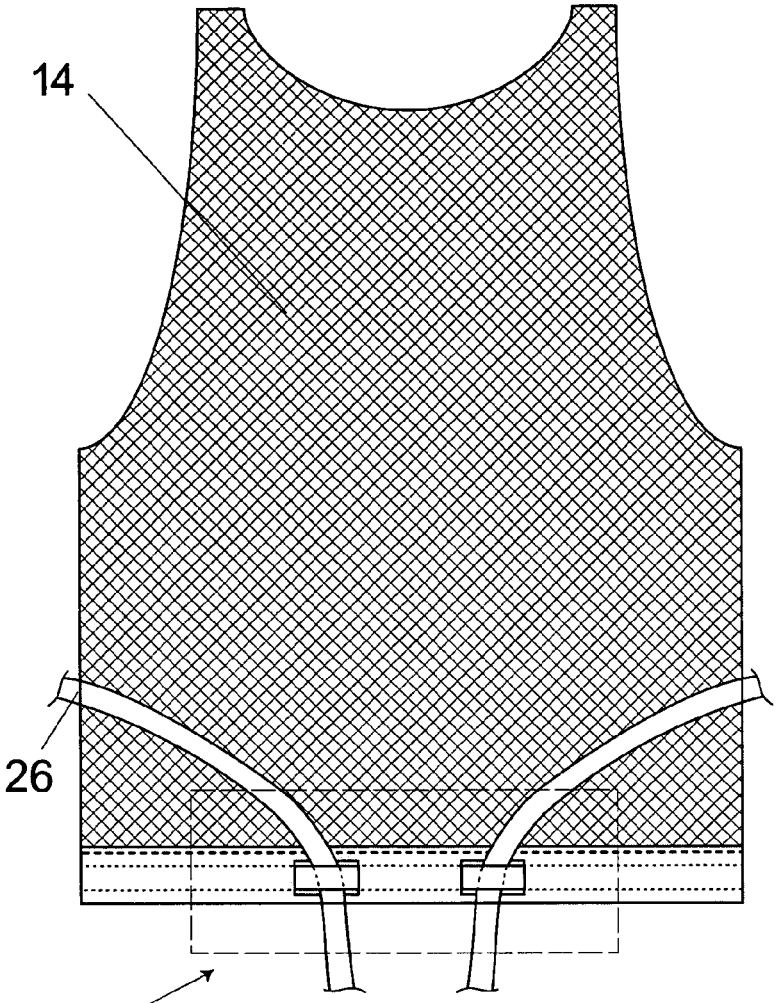
FIG. 4 illustrates an enlarged back view of the garment with the both ends of the lace inserted in a pair of apertures, behind the lace.
Figure 6:
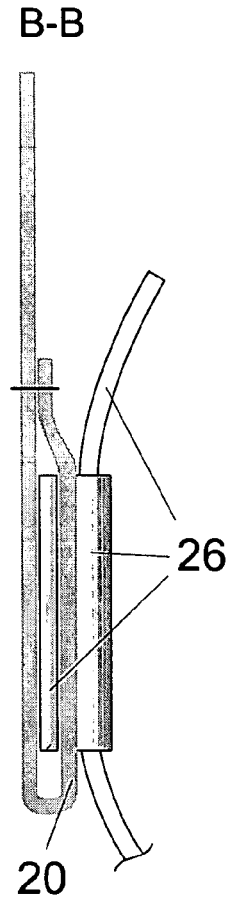
FIG. 6 illustrates a cross-section of FIG. 5 along line B-B.
Figure 5:
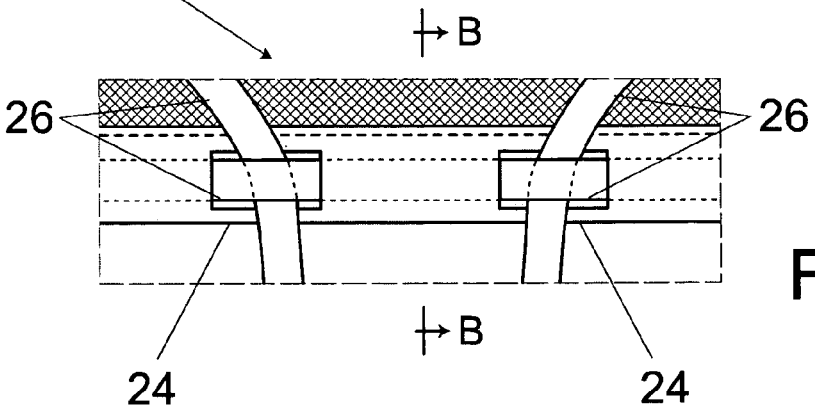
FIG. 5 illustrates an enlarged view of zone A of FIG. 4.

A hem 20 (see FIG. 3) is formed by folding and securing by stitching a lower margin of close-fitting garment 10. A portion of hem 20, corres pair of slits 22, equally spaced from vertical plan of symmetry V-V. Another portion of hem 20, corresponding to back section 14 (see FIG. 4), is provided with a pair of apertures 24, equally spaced from the same vertical plan of symmetry V-V. The distance between the pair of apertures 24 is significantly larger than the distance between the pair of slits 22.

A lace 26 has a first end 28 and a second end 30. Conveniently, the former or the latter is inserted into one of the pair of slits 22 so as to encircle the waist of a person wearing a close-fitting garment 10 and exit through another one of the pair of slits 22. It is practically desirable that first and second ends 28 and 30 which extend outwardly from the pair of slits 22 have substantially the same length.

In the present embodiment, the material used for close-fitting garment 10 should be both soft and breathable, so as not to irritate the skin of a wearer and be stretchable and recoverable to avoid sliding on and rubbing against the skin, so as to trigger irritation and discomfort.

A stretchable material which will produce a soft, breathable and comfortable interface with the wearer is a spandex material. As used herein, the term "spandex" refers to elastic fiber material such as Globe's elastomeric yarn Clearspan® produced by Globe Manufacturing Inc., Full River, Mass. Other spandex yarns that may be used is "Lycra"® spandex manufactured by Du Pont, or "Dorlasten"® manufactured by Bayer.

In addition to providing flexibility and substantially uniform compression, the spandex material, which is multidirectional stretchable, allows freedom of movement of close-fitting garment 10 and provides for intimate skin contact.

Lace 26 is made of an essentially pliant, non-stretchable material and is used for adjustably fastening close-fitting garment 10. A highly-tensioned fit of the latter, longitudinally and circumferentially around and along a wearer's torso and waist can be obtained. To this end, first and second ends 28 and 30 of lace 26, after exiting from the pair of slits 22, are manipulated by the wearer so as to extend downwardly and brought under the crotch area and then up toward the back of the wearer. There, first and second ends 28 and 30 are inserted into the pair of apertures 24, behind lace 26 and then brought forward, stretched and finally tied together in a bow 32.

In detail, a method of avoiding scratching an itchy rash caused by shingles comprises the following steps:

providing a close-fitting garment 10 including a sleeveless, tank top type garment, made of a soft and stretchable material, adapted for covering a part of a body, the sleeveless, tank top type garment having front and back sections 12 and 14 ending with a hem 20, a portion of hem 20 that corresponds to front portion 12 being provided with a pair of slits 22, while another portion of hem 20 that corresponds to back portion 14 being provided with a pair of apertures 24;

means for adjustably fastening said sleeveless, tank top type garment 10 to said upper part of the body, said means for adjustably fastening including a lace 20 having a pair of ends 28 and 30 and adapted to encircle a waist of a person wearing close-fitted garment 10 and to be used in connection with the pair of slits 22 and the pair of apertures 24 to create a longitudinal and a circumferential close-fitting of the sleeveless, tank top type of garment;

positioning the sleeveless, tank top type garment, against and about the part of the body;

manipulating one of the ends 28 or 30 of lace 20 by inserting it into one of the pair of slits 22;

threading one of ends 28 or 30 through hem 20;

pulling out one of ends 28 or 30 through another one of the pair of slits 22 until the pair of ends 28 and 30 have substantially the same length;

bringing the pair of ends 28 and 30 under a crotch area of a wearer of close-fitting garment 10 and then toward a back of said wearer;

inserting the pair of ends 28 and 30 into the pair of apertures 24, behind lace 20;

bringing forward and stretching the pair of ends 28 and 30; and finally tying together the pair of ends 28 and 30.

As required, a detailed embodiment of the present invention is disclosed herein; however, it is to be understood that the disclosed embodiment is merely exemplary of the invention which may be embodied in various forms. Therefore, specific structural and functional details disclosed herein are not to be interpreted as limiting, but merely as a basis for the claims and as representative basis for teaching one skilled in the art to variously employ the present invention in virtually any appropriately detailed structure.

The embodiments of the invention in which an exclusive property or privilege is claimed are defined as follows:

1. A close-fitting garment, adapted for avoiding scratching an itching rash caused by shingles, comprising:

garment means for covering an upper part of a body, made of breathable and stretchable material, tubular shaped and having back and front sections ending with a hem, a portion of said hem, belonging to said front portion, being provided with a pair of slits, while another portion of said hem, belonging to said back portion, being provided with a pair of apertures; and means for adjustably fastening said garment means for covering an upper part of a body, used to create a longitudinally and circumferentially high-tensioned fit of said close-fitting garment, said means for adjustably fastening including a lace provided with a pair of ends, one of the latter, being adaptable to be inserted into one of said slits for circumscribing a waist of a person wearing said close-fitting garment and to exit through another one of said pair of slits, joining another end of said pair of ends, said pair of ends being also adaptable for extending downwardly under a crotch of said wearer and then for bringing up towards a back of said wearer for insertion into said pair of apertures, behind said lace that circumscribes said waist, said pair of ends being finally adaptable to be brought forward for stretching and tying.

2. The close-fitting garment of claim 1, wherein said breathable and stretchable material is spandex.

3. A method for avoiding scratching an itchy rash caused by shingles, said method comprising:

providing a close-fitting garment including garment means for covering an upper part of a body, made of breathable and stretchable material, adapted for covering a part of a body, said garment means for covering an upper part of a body having front and back sections ending with a hem, a portion of said hem that corresponding to said front portion being provided with a pair of slits, while another portion of said hem that corresponds to said back portion being provided with a pair of apertures;

means for adjustably fastening said garment means for covering an upper part of a body, said means for adjustably fastening including a lace having a pair of ends and adapted to encircle a waist of a person wearing said close-fitted garment and to be used in connection with said pair of slits and said pair of apertures to create a longitudinal and a circumferential close-fitting of said garment means for covering an upper part of a body;

positioning said garment means for covering an upper part of a body against and about said upper part of said body;

manipulating one of said ends of said lace by inserting it into one of said pairs of slits;

threading said one of said ends through said hem;

pulling out said one of said ends through another one of said pair of slits until said pair of ends have substantially the same length;

bringing said pair of ends under a crotch area of a wearer of said close-fitting garment and then towards a back of said wearer;

inserting said pair of ends into said pair of apertures, behind said lace;

bringing forward and stretching said pair of ends; and finally tying together said pair of ends.

* * * * *